US006977360B2

(12) United States Patent
Weiss

(10) Patent No.: US 6,977,360 B2
(45) Date of Patent: Dec. 20, 2005

(54) TEXTILE HEATING DEVICE

(75) Inventor: Michael Weiss, Benediktbeuren (DE)

(73) Assignee: W.E.T. Automotive Systems AG (DE)

( * ) Notice: Subject to any disclaimer, the term of this patent is extended or adjusted under 35 U.S.C. 154(b) by 435 days.

(21) Appl. No.: 10/204,586

(22) PCT Filed: Dec. 21, 2001

(86) PCT No.: PCT/DE01/04837

§ 371 (c)(1),
(2), (4) Date: Oct. 16, 2002

(87) PCT Pub. No.: WO02/052898

PCT Pub. Date: Jul. 4, 2002

(65) Prior Publication Data

US 2003/0089704 A1 May 15, 2003

(30) Foreign Application Priority Data

Dec. 22, 2000 (DE) ..... 100 64 771

(51) Int. Cl.[7] ..... H05B 3/54

(52) U.S. Cl. ..... 219/545; 211/212; 211/529; 211/549; 392/432

(58) Field of Search ..... 219/545, 211, 219/212, 217, 528, 529, 544, 546, 549, 542; 392/407, 425, 432, 435

(56) References Cited

U.S. PATENT DOCUMENTS

| | | | | | |
|---|---|---|---|---|---|
| 4,713,531 | A | * | 12/1987 | Fennekels et al. | 219/545 |
| 5,475,203 | A | * | 12/1995 | McGaffigan | 219/545 |
| 5,484,983 | A | * | 1/1996 | Roell | 219/545 |
| 5,837,971 | A | * | 11/1998 | Lee | 219/212 |
| 5,908,573 | A | * | 6/1999 | Chiles et al. | 219/545 |
| 6,294,768 | B1 | * | 9/2001 | Liebich | 219/528 |
| 6,331,695 | B1 | * | 12/2001 | West | 219/212 |
| 6,521,873 | B1 | * | 2/2003 | Cheng et al. | 219/528 |
| 6,664,512 | B2 | * | 12/2003 | Horey et al. | 219/212 |
| 6,794,610 | B2 | * | 9/2004 | Horey et al. | 219/212 |

* cited by examiner

*Primary Examiner*—Fadi H. Dahbour

(57) ABSTRACT

A textile heating device having a plurality of electrically conductive heating strands in contact with each other at a plurality of points of contact by way of respective contact surfaces is provided. The electrically conductive textile includes at least two strands which are fixed relative to each other at at least one point of contact such that a contact area at the fixed at least one point of contact between the contact surfaces remains essentially constant during mechanical action of the textile.

17 Claims, 2 Drawing Sheets

TEXTILE HEATING DEVICE

BACKGROUND OF THE INVENTION

The present invention relates to a textile heating device.

Textile heating devices are known in principle. They are based on electrically conductive textiles, or electrically conductive textile filaments, used as electrical resistance conductors for heating. The conductivity of the textile, or of the filament, is brought about for example by metallic coating of the fibers or by inclusion of graphite particles in synthetic filaments. As textiles for the generic heating devices, woven and knit fabrics are employed in particular.

A temperature control is usually effected in terms of controlling the voltage and/or current of the textile heating device. Hence, an accurate and dependable temperature control requires as accurate a knowledge as possible of the electrical resistance of the textile, or of the textile heating device. In practice, however, it turns out that this requirement is often inadequately met. The resistances of the heating devices of the prior art fluctuate widely from case to case, according to mode of installation or employment and load condition, and in particular deviate from the resistances of the uninstalled heating textile.

SUMMARY OF THE INVENTION

One object of the present invention is to create a textile heating device comprising a defined resistance, remaining constant in different modes of installation or load conditions.

A textile heating device having a plurality of electrically conductive heating strands in contact with each other at a plurality of points of contact by way of respective contact surfaces is provided. The electrically conductive textile includes at least two strands which are fixed relative to each other at at least one point of contact such that a contact area at the fixed at least one point of contact between the contact surfaces remains essentially constant during mechanical action of the textile.

In a textile heating device according to the invention, contacts of electrically conductive heating strands are so fixed that the relative position of the contacts and the contact surfaces of the strands remain substantially unchanged among themselves, even upon movement of the heating textile and loading thereof. Mechanical action is here understood to mean any exertion of force on the heating textile that leads to temporary or permanent elastic or plastic deformation or change of textile form, and lies below the limit of strength of the textile. In other words, the textile, or textile structure, is not, or is only inappreciably, destroyed by the action of the force. The total resistance of the resistance network formed by the heating strands in the textile remain essentially unchanged by fixation of the points of contact, even with movement and loading of the textile. A heating strand preferably comprises a plurality of textile filaments having at least one electrically conductive filament, but may alternatively be configured in the form of a single or several electrically conductive filaments.

The accomplishment of this object is based on the discovery that in conventional heating textiles, the resistance will vary in different modes of installation and load conditions because the positions of the points of contact and also the size of the areas of contact between the several electrically conductive heating strands or filaments will vary due to tensile load, folding or similar changes of shape. To create as constant a total resistance of the heating textile as possible, therefore, the points and areas of contact of the several filaments with each other must remain unchanged even in case of movement and loading of the textile. The textile heating device according to the invention is distinguished in that two neighboring heating strands of the textile are connected at a fixed distance relative to each other and with a fixed area of contact. That is, upon expansion of the strands or filaments of the textile, the points of contact of the filaments/strands are moved along in accordance with the expansion. Therefore defined, constant points of contact are created, affording a constant total resistance of the heating textile even under different service conditions.

In a preferred embodiment of the invention, two neighboring heating strands are knotted together at the point of contact. Here it is important that the pre-stress created by the knotting with respect to the contact, or touching, of the heating strand, shall withstand the forces due to loading of the textile and therefore prevent alteration of position and contact area of the points of contact of the strand.

The foregoing connection of two filaments by knotting is known in the art as "maquisette" technique, and is employed for production of tulle, curtains and the like. In advantageous manner, the heating textile according to the invention may therefore be fabricated on conventional textile machines.

In another advantageous embodiment of the invention, additional fixing means are provided to fix the points of contact. Such fixing means comprise means for lasting connection of strands or filaments, such as clips, clamps or adhesives. The filaments/strands, however, may alternatively be connected by welding or compressing at their points of contact. Depending on the kind of textile employed, viz. woven, knit or other stuff, or on the materials employed, the modes of fixation just enumerated by way of example afford advantages respecting production costs or outlay, load capacity, i.e. desired service life, and material properties of the heating textile, for example elasticity and deformability.

In a preferred embodiment of the invention, the points of contact of the heating strands are fixed by means of a particular connecting filament. Here preferably two heating strands at a time are knotted to the connecting filament. However, other geometrical and/or dynamic modes of connection are possible, such as for example a spiral wrapping of the strands with the connecting filament. For the connection with the connecting filament, again, it is decisive that the tension introduced by the connecting filament press the two strands together more firmly than it will be counteracted by subsequent loading.

In a preferred refinement of the invention, electrode strands or filaments are knitted into the heating textile. These electrode strands possess a definitely lower resistance than the heating strands and serve to contact them. Specifically, the electrode strands are worked in at least at opposed ends of the heating textile and thus advantageously permit an effective and economical contacting of the heating strands.

In another preferred refinement of the invention, at least a portion of the plurality of electrode strands are arranged distanced from each other and running essentially in the same direction of extension. Advantageously, what this accomplishes is that the distance between the electrode strands, i.e. the distance to be electrically bridged between two electrode strands, is reduced. Compared to the great distance when the electrode filaments are provided only at opposed ends of the heating textile, this distance is subdivided into a plurality of smaller distances. Therefore, the resistance present between two neighboring electrode strands is reduced correspondingly. A heating device according to the invention, having electrode strands worked in, may consequently be advantageously operated at lower voltage. With unchanged voltage, on the other hand, heating strands of higher ohmage may be employed.

In a preferred embodiment of the invention, the distances between individual electrode strands are from 0.5 to 40 cm, in particular 2 to 8 cm. Depending on choice of resistance of the heating strands, the heating textiles according to the invention may be operated at such electrode strand distances with relatively low voltages, in particular the conventional voltages in automobiles. These textile heating devices are therefore especially suitable for automotive applications, such as heated seats for example.

In an advantageous refinement, the points of contact of electrode strands and heating strands are of fixed design. Here, the same fixations are used as are also employed to fix the points of contact of the heating strands among themselves. In conventional contactings, electrode strands are sewn onto a heating textile, arranged side-by-side, usually in 5- or 7-fold redundancy, to ensure a secure contact with the heating conductors. This advantageous refinement permits a reduction of the number of electrode strands to one or two strands in each instance, since the electrical contacts between heating strand and electrode strand is brought about, securely and reliably, by fixation of the connection, or point of contact, for example by knotting or by means of auxiliary filaments.

In a preferred embodiment of the invention, at regular distances an electrode strand is worked into the textile in each instance in place of a heating strand. This simplifies the incorporation of the electrode strands, since these are worked in in the same manner as the heating strands. Advantageously, a fixation of the point of contact of electrode strand and heating strand is effected similarly to the fixation of points of contact of heating strands among themselves.

Other advantages and embodiments of the invention appear from the description and the accompanying drawing.

It will be understood that the features mentioned above and those yet to be illustrated may be used not only in the particular combination specified but also in other combinations or alone, without departing from the scope of the present invention.

BRIEF DESCRIPTION OF THE DRAWINGS

The invention is schematically represented in the drawing in terms of an embodiment by way of example, and will be fully described below with reference to the drawing.

DETAILED DESCRIPTION OF THE INVENTION

Figure 1:
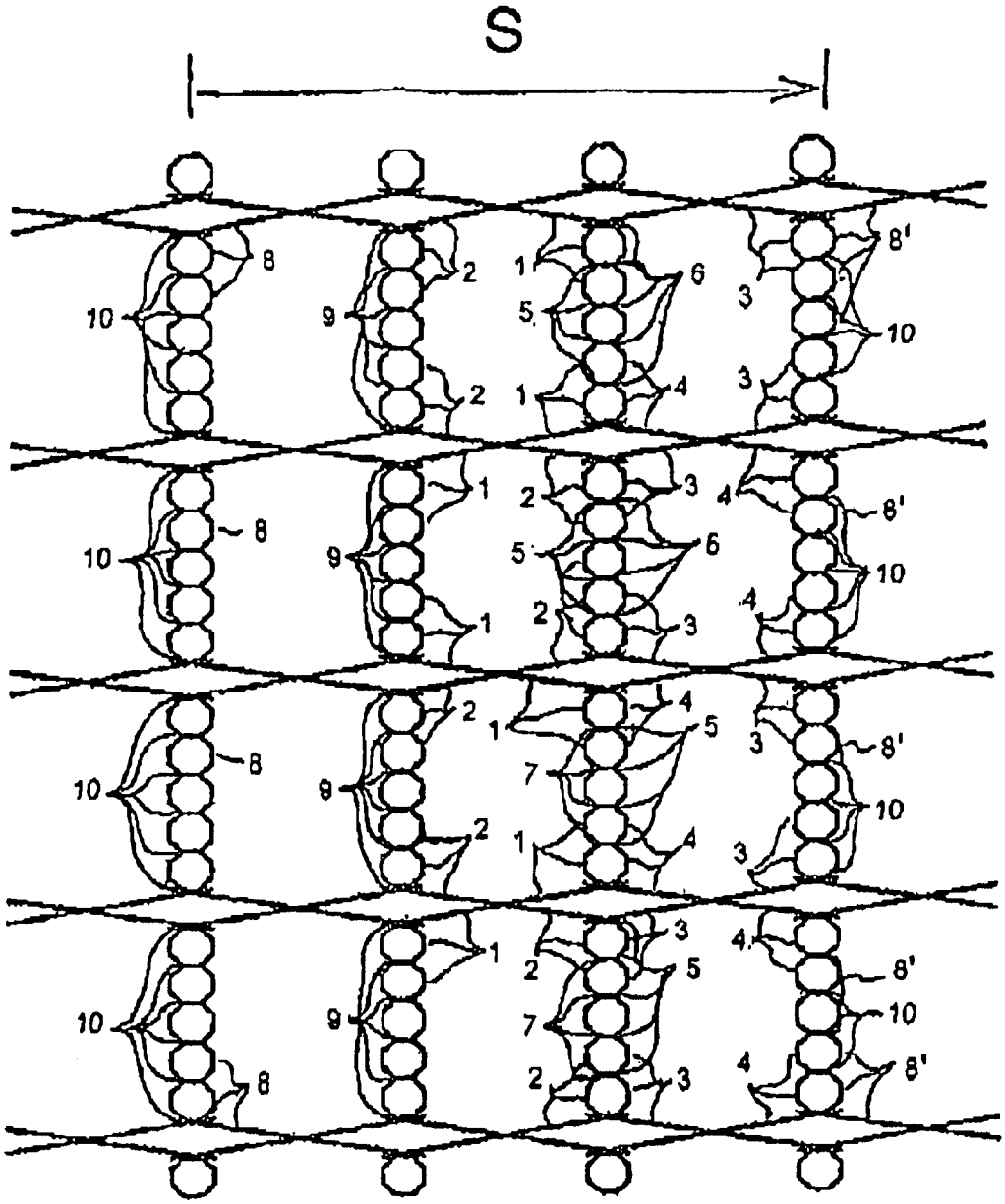
FIG. 1 shows an enlarged view of a heating textile according to the invention in the form of a knit fabric, schematically represented.

FIG. 1 shows, in enlarged representation, a portion of a heating textile according to the invention, present in the form of a knit fabric. The knit consists basically of three different types of strands or filaments. Reference numerals 1 to 4 and 8 and 8' designate strands serving as conductors of electric current. Specifically, they are heating strands 1 to 4 and electrode strands 8, 8' of the knit. On the other hand, reference numeral 5 designates a connecting filament, making a fixed connection of the points of contact 9, 10 of the electrically conductive strands 1 to 4, 8, 8'. The arrow designated by the letter S indicates the direction of the flow of current through the heating textile when a correspondingly directed voltage is applied to the electrode strands 8, 8'.

For the electrical junction of a heating textile, use is made of electrodes, commonly bonded, sewn, riveted or otherwise attached to the textile conductively by means familiar to those skilled in the art.

Figure 2:
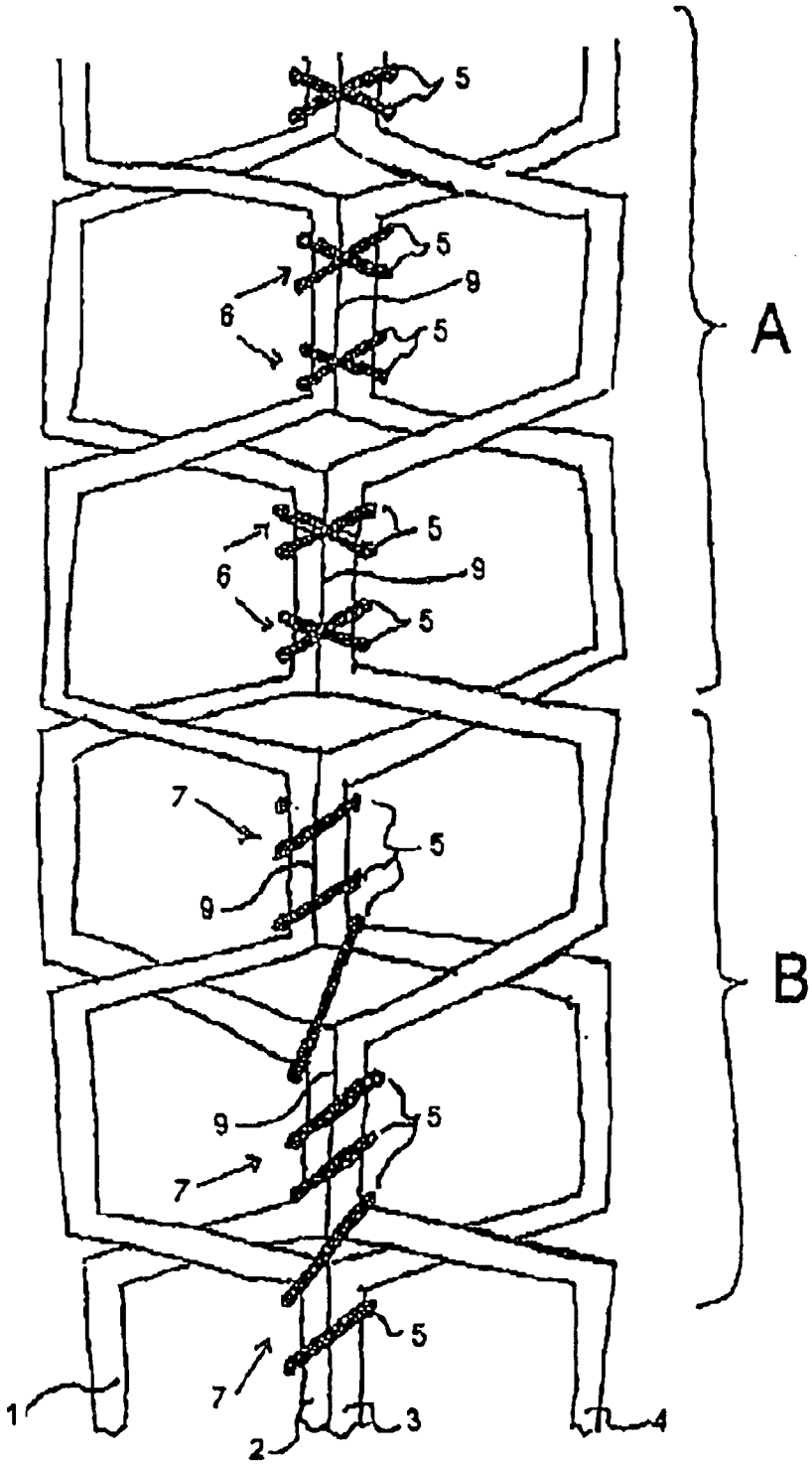
FIG. 2 shows a detail view of the knit of FIG. 1, with different modes of connection between heating strands among themselves, or between heating strands and electrode strands.

In the preferred embodiment of the invention represented in FIGS. 1 and 2, electrode strands 8, 8' are advantageously worked into the heating textile. The electrode strands 8, 8' are each preferably worked into the textile at regular distances, each in place of a heating filament/strand, permitting simple fabrication. For reasons of graphic representation, only two electrode strands 8, 8' are shown, though arranged in suitable continuation in the textile heating device according to the invention. The fixation of the points of contact 9, 10 according to the invention permits a reduction of the number of electrode strands 8, 8' at a point of junction to one or two strands each, since the electrical contact between heating strands 1 to 4 and electrode strands 8, 8' is secured by the fixation. In FIG. 1, a single electrode strand 8, 8' is provided at each junction.

The distances between electrode strands 8, 8' of different junctions are preferably 2 to 8 cm.

Such relatively short and uniform contacting distances can be achieved because even one or at most two electrode strands 8, 8' will achieve a secure electrical contact. On the basis of the small distance of the worked-in electrode strands 8, 8', the textile heating device according to the invention can be designed for operation at low voltage, for example in the range from 10 to 50 V. This is especially advantageous for automotive applications.

The electrode strands 8, 8' are preferably arranged undulating, or sinusoidal, in the heating textile, promoting long service life of the electrodes 8, 8'. The bowed portions of the electrodes 8, 8' can more readily accommodate deformations of the textile than linearly arranged electrodes, which are therefore subject to more wear, i.e. may more readily tear or break.

The electrode strands 8, 8' are made for example of copper, aluminum, gold or silver, or materials coated with such, and have a distinctly lower resistance than the heating strands 1 to 4. The resistance of the electrode strands 8, 8' is preferably around 0.1 ohm/meter. On the other hand, the strands provided as heating strands 1 to 4 have a resistance of about 300 ohms. As heating strands, use may be made for example of cellulose filaments with graphite filler.

The points of contact 9 and 10 between heating strands 1 to 4, or between heating strands 4 and electrode strands 8, 8', in the embodiment represented by way of example, are fixed by means of a connecting filament 5, the connection being shown in detail in FIG. 2.

FIG. 2 shows an enlarged detail view of FIG. 1. In FIG. 2, two kinds of fixation by means of a connecting filament 5 are shown for the example of points of contact 9 of the heating strands 1 to 4. The connecting filament 5, however, may also connect heating strands 1 to 4 to electrode strands 8, 8' in like manner.

In the portion of FIG. 2 designated by the letter A, the heating strands 1 to 4 are securely fixed to each other by means of the connecting filament 5 at knots 6. For the connection, one or more connecting filaments 5 may be provided, knotted about the heating strands 1 to 4 point-to-point or continuously. In portion B of FIG. 2, another mode of connection is represented, in which the connecting filament 5 securely fixes the points of contact 9 of the heating strands 1 to 4 by means of a spiral looping 7.

As connecting filaments 5, for example polyethylene material is suitable. The connecting filament may itself be made electrically conductive.

The heating textile according to the invention is distinguished by an over-all resistance that remains largely unchanged even if the textile is moved or under load. Furthermore, the heating textile according to the invention permits better further processing. The heating textile may be fabricated as goods in rolls, and cut into individual pieces of textile according to need or purpose. By way of the woven-in electrode strands, the cut heating textile may then be electrically connected in simple manner, for example by assigning a pole to every second electrode strand.

The heating textile according to the invention may be fabricated advantageously in very widely varying mesh sizes, better taking account of different conditions of service and realizing savings of material.

What is claimed is:

1. An electrically conductive textile suitable for heating comprising a plurality of electrically conductive heating strands in contact with each other at a plurality of points of contact by way of respective contact surfaces, and a plurality of electrode strands arranged in the textile, for electrical contacting of the plurality of heating strands, wherein at least two of the heating strands are fixed relative to each other at at least one point of contact by way of a fixation such that a contact area at the fixed at least one point of contact remains essentially constant during mechanical action on the textile, and wherein, at regular distances, an electrode strand is worked into the textile in place of a heating strand in each instance.

2. An electrically conductive textile according to claim 1, wherein the at least two heating strands are fixed by knotting the strands to each other at the at least one point of contact.

3. An electrically conductive textile according to claim 2, comprising fixation means for fixing the at least two heating strands.

4. An electrically conductive textile according to claim 3, wherein the fixation means comprise at least one auxiliary filament binding the at least two heating strands to each other at the at least one point of contact.

5. An electrically conductive textile according to claim 4 wherein the auxiliary filament is made of polyester.

6. An electrically conductive textile according to claim 1, wherein at least a portion of the plurality of electrode strands are distanced from each other and arranged to run in essentially the same direction of extent.

7. An electrically conductive textile according to claim 1 wherein the plurality of electrode strands are spaced from each other approximately 0.5 to 40 cm.

8. An electrically conductive textile according to claim 1 wherein the fixed points of contact are fixed by way of electrode strands and heating strands.

9. An electrically conductive textile according to claim 1 wherein the textile is formed essentially by the electrode strands and the heating strands, and wherein the textile is a knit.

10. An electrically conductive textile according to claim 1 wherein the electrode strands each comprise at least one thread of metal filament or a metallic wire.

11. An electrically conductive textile according to claim 1 wherein the heating strands each comprise at least one carbon filament, a graphite-filled cellulose filament, or an electrically conductive substance filament.

12. An electrically conductive textile suitable for heating comprising a plurality of electrically conductive heating strands in contact with each other at a plurality of points of contact by way of respective contact surfaces, and a plurality of electrode strands arranged in the textile, for electrical contacting of the plurality of heating strands, wherein at least two of the heating strands are fixed relative to each other at at least one point of contact by way of a fixation such that a contact area at the fixed at least one point of contact remains essentially constant during mechanical action on the textile, and wherein the electrode strands are arranged undulated or sinusoidal in the heating textile.

13. An electrically conductive textile comprising a plurality of electrically conductive heating strands each in contact with each other at a plurality of contact areas by way of respective contact surfaces, and a plurality of electrode strands arranged in the textile for electrically contacting the heating strands, wherein at least one of the contact areas is fixed such that it remains substantially constant in size during mechanical loading of the textile, and wherein at least two of the plurality of electrode strands are in contact with each other at a plurality of contact areas by respective contact surfaces and at least one of the electrode strand contact areas is fixed such that it remains substantially constant in size during mechanical loading of the textile.

14. An electrical conductive textile comprising a plurality of electrically conductive heating strands each in contact with each other at a plurality of contact areas by way of respective contact surfaces, and a plurality of electrode strands arranged in the textile for electrically contacting the heating strands, wherein at least one of the contact areas is fixed such that it remains substantially constant in size during mechanical loading of the textile, and wherein the plurality of electrode strands are arranged substantially sinusoidally in the heating textile.

15. An electrically conductive textile according to claim 14 wherein the at least one fixed contact area is fixed by an auxiliary filament.

16. An electrically conductive textile according to claim 14 wherein at least a portion of the plurality of electrode strands are spaced from each other and arranged to run in essentially the same direction of extent.

17. An electrically conductive textile according to claim 14 wherein the electrode strands each comprise at least one thread of metal filament or a metallic wire and wherein the heating strands each comprise at least one carbon filament, graphite-filled cellular filament, or an electrically conductive filament.

* * * * *